United States Patent [19]

Schroeder

[11] Patent Number: 4,958,137

[45] Date of Patent: Sep. 18, 1990

[54] ELECTROMAGNETIC RELAY

[75] Inventor: Harry Schröeder, Unterhaching, Fed. Rep. of Germany

[73] Assignee: Siemens Aktiengesellschaft, Berlin and Munich, Fed. Rep. of Germany

[21] Appl. No.: 408,070

[22] Filed: Sep. 15, 1989

[30] Foreign Application Priority Data

Oct. 14, 1988 [DE] Fed. Rep. of Germany ..... 3835118

[51] Int. Cl.[5] ..... H01H 67/02

[52] U.S. Cl. ..... 335/128; 335/80; 335/83

[58] Field of Search ..... 335/78–85, 335/121, 124, 128, 229, 230

[56] References Cited

U.S. PATENT DOCUMENTS 4,618,842 10/1986 Nestlen et al. ..... 335/128
4,740,769 4/1988 Mitschik ..... 335/78

FOREIGN PATENT DOCUMENTS 0161473 11/1985 European Pat. Off. .
0251034 7/1988 European Pat. Off. .
1906109 2/1964 Fed. Rep. of Germany .
1514538 5/1969 Fed. Rep. of Germany .
7037474 5/1971 Fed. Rep. of Germany .
3539944 5/1986 Fed. Rep. of Germany .
265732 3/1989 German Democratic Rep. .

*Primary Examiner*—Leo P. Picard
*Assistant Examiner*—Lincoln Donovan
*Attorney, Agent, or Firm*—Hill, Van Santen, Steadman & Simpson

[57] ABSTRACT

An electromagnetic relay comprises a base member, an electromagnet system including a coil, a core and an armature, and a contact arrangement anchored in the base member and having at least one movable contact spring that is switched by a rod-shaped actuation element. The contact location and the attack point of the actuation element at the contact spring are offset relative to one another such that they lie a distance from one another in a projection onto the bottom surface of the base member so that the attach point and the contact location are prevented from lying above one another in all assembled attitudes that come into consideration and so that abraded material of the actuation element cannot fall onto the contact location and contaminate the contact surfaces.

9 Claims, 2 Drawing Sheets

ELECTROMAGNETIC RELAY

BACKGROUND OF THE INVENTION

1. Field of the Invention:

The present invention is related to an electromagnetic relay, and more particularly to an electromagnetic relay comprising a base member having a bottom surface forming the terminal side of the relay, an electromagnet system arranged on the base member and having a coil, core and armature, a contact arrangement anchored in the base member having at least one cooperating contact element and at least one movable contact spring whose contact legs are provided with contact locations and extend essentially perpendicular to the bottom surface, and an actuation element transmits the armature movement onto the contact spring.

2. Description of the Prior Art

Such a relay is disclosed, for example, in the German patent No. 34 14 731. In the example therein, an actuation slide, with reference to the terminal side of the relay, lies above the magnet system and also above the contact arrangement, wherein the slide attacks at a middle contact spring directly above the contact locations. Since the slide must be composed of plastic material, a certain abrasion can never be entirely avoided. In the normal mounting position of the relay, however, this abraded material falls downward in the direction onto the contact pieces and therefore there is a risk that superfine particles of the insulating material of the slide will contaminate the contact surfaces and increase the transfer resistance over the course of time.

A similarly-constructed relay is disclosed in German patent No. 35 39 944, whereby, however, the slide lies at the terminal side of the relay under the magnet system. In the normal assembly condition of the relay, therefore, the contact locations lie above the slide, so that the abraded material does not drop onto the contact surfaces. This arrangement comprising the slide lying between the contact locations and the terminal side, however, has the disadvantage that a switch-over contact cannot be formed without further expense, since the centrally-arranged slide would intersect with the second cooperating contact element that is likewise centrally arranged. Although it is possible to provide the second cooperating contact element with a recess for the slide, a complicated fabrication and assembly therefore derive. Moreover, it must be taken into consideration that relays can also be assembled such on printed circuitboards that the terminal side lies at the top. In this case, the coupling location between the slide and the contact spring in this second-mentioned relay would also lie above the contact location and the abraded dust would fall onto the contact surfaces.

SUMMARY OF THE INVENTION

It is an object of the invention to provide a relay of the type generally set forth above wherein the risk that abraded material drops from the actuation element onto the contact locations is largely avoided, whereby a simple structure and a simple allocation between contact arranqement, magnet system and actuation element is achieved at the same time.

In a relay of the type set forth above, the object is achieved, according to the present invention, in that the contact location and the attack point of the actuation element are offset relative to one another at the contact spring such that, in the projection onto the bottom surface, they are spaced from one another.

In a relay constructed in accordance with the present invention, therefore, the actuation element attacks laterally offset relative to the contact location at the actuation element, so that the attack location does not lie above the contact location either in the normal assembled attitude or an inverted assembled attitude. Due to the laterally-offset arrangement, an actuation element can also be easily moved past a cooperating contact element even given a switch-over contact without a special shaping of the contact element or of the actuation element being required for this purpose. A laterally offset actuation of the contact spring, moreover, also yields the advantage that the torsional motion produced as a result thereof in the contact spring effects a rolling of the contact pieces, this enabling a self-cleaning effect or, respectively, an easier opening of the contacts if these are easily fused by arcing.

When the attack point is laterally offset relative to the contact location in the same plane, it could however occur that the attack point of the actuation element would come to lie over the contact location giving assembly of the relay at a vertically-accommodated printed circuitboard. In order to also suppress this case, it is provided according to an advantageous feature of the invention, that the contact location and the attack point of the actuation element are additionally also offset in height relative to one another with respect to the bottom surface. In this case, contact location and actuation location of the contact spring therefore lie obliquely offset relative to one another with reference to the terminal side, so that the arising abraded material will not fall downward next to the contacts and therefore no longer directly contaminate the contact locations given an erect or prone assembly in an arbitrary attitude. Having the contact location and the actuation location of the contact spring lying on top of one another could then only occur if the relay were assembled in a very specific oblique attitude, this, however, being extremely improbable.

The design of a relay in accordance with the present invention can be employed particularly beneficially in a relay wherein the coil has its axis lying parallel to the bottom surface, wherein the armature is arranged at an end face of the coil approximately perpendicularly relative to the bottom surface and wherein the contact location is arranged in front of that end face of the coil lying opposite the armature, as disclosed, for example, in the initially mentioned German patent 34 14 731. A rod-shaped slide extending in the direction of the coil axis at the outside of the coil thereby serves as the actuation element, whereby the contact locations of the contact arrangement are arranged at one side and the slide is arranged at the other side with reference to a plane extending through the coil axis and residing perpendicularly relative to the bottom surface when the yoke thereby has one leg seated above the coil, the slide is arranged between the coil and base plate. An additional advantage with reference to this structural size can thereby also derive in that the slide dislocated out of the center toward the side can be partially arranged in the space between the round coil cross section and the corner of the rectangular base member or, respectively, housing that is otherwise not employed.

For the attack of the slide, an actuation tab that is obliquely offset relative to the contact location is applied or, respectively, cut at the free end of the contacting leg of the contact spring. For adaptation of the force-distance characteristic of the relay, for example, this attached actuation tab can be executed particularly narrow or a web having a reduced cross section can be provided between the actuation tab and the actual contact leg.

In an advantageous embodiment of the invention, the contact spring itself has the approximate shape of an inverted U, whereby it has one leg secured at a terminal element anchored in the base member and has its second leg carrying a contact piece and forming a contact location for the slide. In a preferred, structural design of the contact arrangement, one or two cooperating elements are anchored in the base member in the region of one side, whereas the terminal element for the contact spring is anchored in the region of the opposite side of the base member, whereby the two legs of the contact spring are offset obliquely relative to one another in parallel planes. Given a most beneficial space utilization, an optimally wide spacing of the terminal elements and an optimally great spring length of the contact springs are obtained in this manner. The terminal element for the contact spring, moreover, can comprise an adjustment web reduced in cross section.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
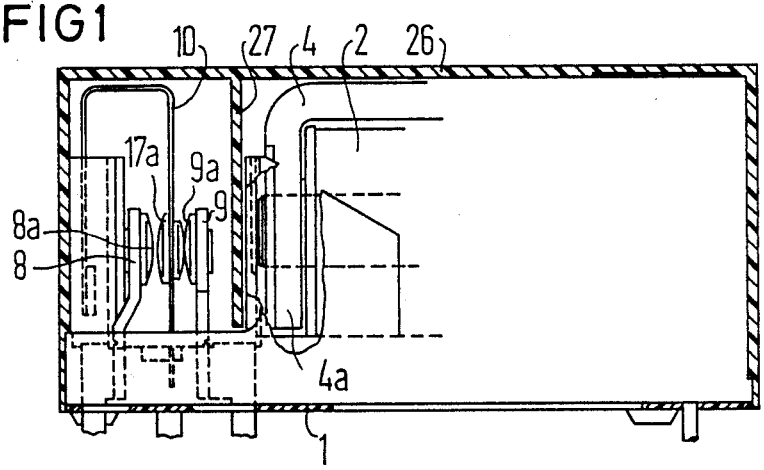
FIG. 1 is a sectional view of an electromagnetic relay constructed in accordance with the present invention and taken generally along the line I—I of FIG. 2.
Figure 2:
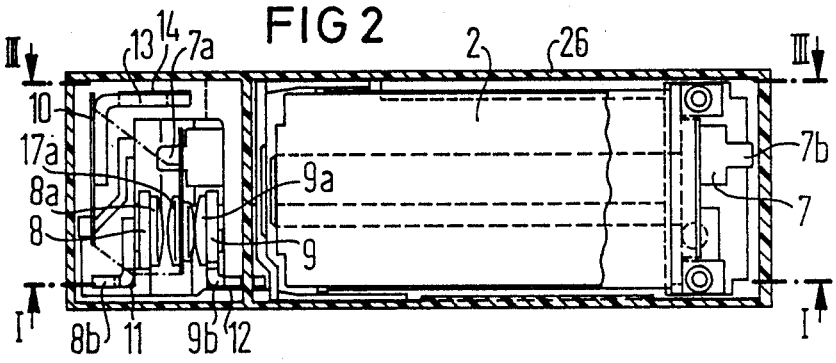
FIG. 2 is a sectional view of the electromagnetic relay of FIG. 1, taken generally along the line II—II of FIG. 3.
Figure 3:
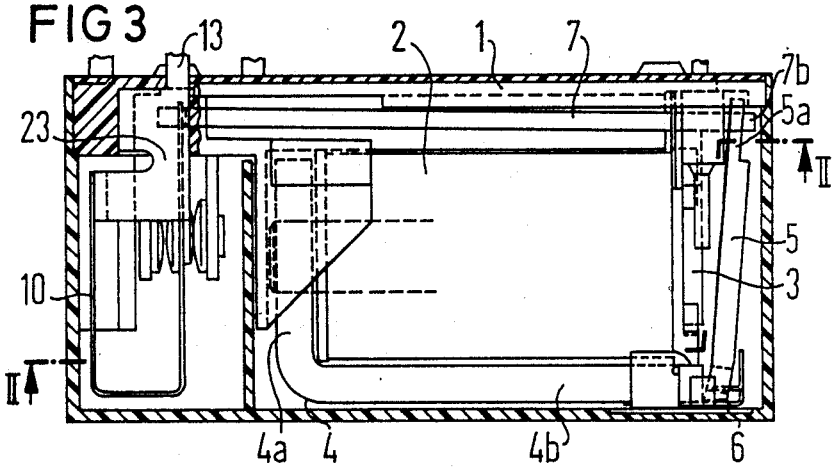
FIG. 3 is a sectional view of an electromagnetic relay taken generally along the line III—III of FIG. 2.

Referring to the drawings, all of the parts of the electromagnetic relay of FIGS. 1–3 are not shown in each view inasmuch as they are shown in the other views and the armature has been omitted in FIG. 2 in order to more clearly show the slide.

Figure 4:
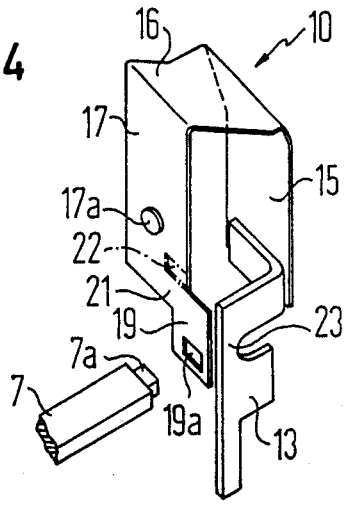
FIG. 4 is an exploded perspective view of the base member, the contact spring and the actuation slide of the electromagnetic relay of FIGS. 1–3.
Figure 4:
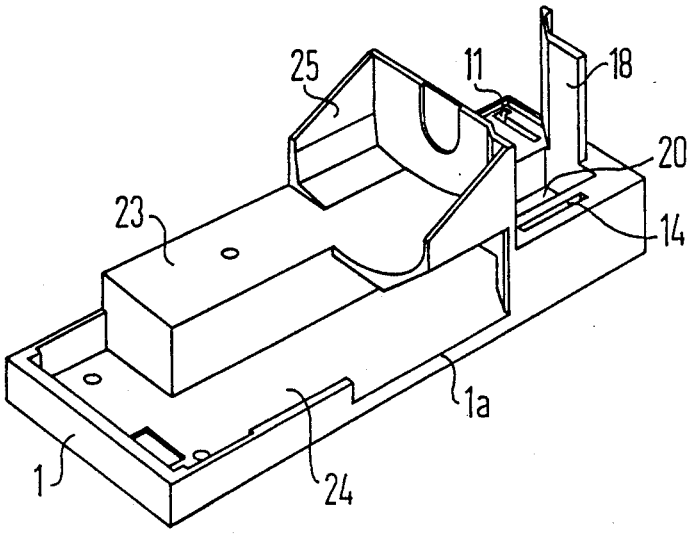

The relay shown in FIGS. 1–3 has a base member 1 comprising a bottom surface la and a shaping shown in greater detail in FIG. 4. A magnet system comprising a coil 2 and a core 3 arranged in the axial direction inside the coil, an angled yoke 4 and a flat armature 5 are arranged on the base member 1. The coil axis thereby extends parallel to the terminal plane of the relay. The yoke 4 is arranged such that its short leg **4*a* extends perpendicular to the terminal plane in front of the one end face of the coil and is connected to the core, whereby its long leg 4*b* extends parallel to the terminal plane but above the coil 2 and has its free end forming a bearing for the armature 5. A leaf spring 6 is shaped as a bearing plate and armature spring and serves the purpose of supporting the armature 5 at the free yoke end, a special shaping thereof being described and shown in European patent No. 0 251 035. The armature 5 extends in front of that end face of the coil lying opposite the yoke leg 4*a* and forms a working air gap with the free end of the core 3. The plate-shaped armature 5 thereby extends approximately perpendicularly relative to the terminal plane of the relay, so that its free end 5*a* is located at the underside of the magnet system. The free end 5*a* is coupled to a rod-shaped slide 7 that extends up through the coil 2** parallel to the axis thereof, but that is arranged offset out of the center toward one side.

A contact arrangement is anchored in the base member 1 in front of that end of the coil 2 lying opposite the armature. This contact arrangement is composed of two stationary cooperating contact elements 8 and 9 having respective contact pieces **8*a* and 9*a* and of a center contact spring 10. The cooperating contact elements 8 and 9 have their angled-off terminal elements 8*b* and 9*b*, respectively, anchored in corresponding slots or clearances 11 and 12, respectively, of the base member 1. The cooperating contact elements 8 and 9 are arranged displaced out of the center toward the side opposite relative to the slide 7. The middle contact spring 10 is secured in a slot 14 of the base member 1 at the side of the slide 7, by way of a connector angle 13**.

The specific shape of the contact spring 10 may be seen in the perspective illustration of FIG. 4. The spring thereby has an approximate U-shape comprising a fastening leg 15, a middle part 16 and contact leg 17. The middle part 16 thereby has approximately the shape of a parallelogram, so that the contact leg 17 is arranged offset parallel relative to the fastening leg 15. Together with the connector angle 13, therefore, the fastening leg 15 is located at one side of the base member 1 in extension of the slide 7, whereas the contact leg 17 is located at the other side of the base member 1 between the cooperating contact elements 8 and 9. Deriving as a result of this shape of the contact spring 10 is, first of all, a great spring length and, secondly, also the possibility of arranging the connector angle 13 at a great distance from the terminal legs **8*b* or, respectively, 9*b* of the cooperating contact elements for insulation. For improving the insulation between the terminal parts, the base member 1 also comprises an upwardly-applied partition 18**.

In order to then be able to actuate the contact leg 17 with the slide 7 arranged at the opposite side of the base member, an actuation tab 19 is located in the extension of the slide 7 and extends into a recess 20 of the base member 1 in which the slide is also located. A projection **7*a* of the slide 7 thereby engages into an aperture 19*a* of the actuation tab 19. The other end of the slide 7 is coupled to the armature with a projection 7*b*** in the same manner.

The advantage that the actuation location does not lie above the contact piece **17*a* in the normal assembled attitude nor in any assembled attitude turned by 90° or 180° derives due to the offset arrangement of the actuation tab 19 oblique toward the side and downward in comparison to the contact leg 17, or respectively, to the contact piece 17*a* and as a result of the obliquely offset attack of the slide 7 caused as a result thereof. Abrasion of the projection 7*a* that may potentially arise in the region of the aperture 19*a*** therefore always falls down in the housing next to the contact location.

The offset arrangement of the actuation tab 19 relative to the contact leg 17 also has the advantage that a certain torsional stressing of the contact spring 10 and, therefore, a rolling motion of the contact piece **17*a* is generated upon actuation. As a result thereof, the contact can be easily broken open even after slight fusing. The force-distance characteristic of the relay can also be set by dimensioning the connecting web 21 between the contact leg 17 and the actuation leg 19. For further balancing of this force-distance characteristic, an additional slot 22 (indicated with broken lines in FIG. 4**) could also be provided in this region.

A notching for the formation of a reference bending point 23 is provided at the connector angle 13 in order to be able to adjust the position of the contact spring 10. Further, it should also be pointed out that the exemplary embodiment shows a switch-over contact arrangement. Without other modification, a make contact can be acquired by omitting the cooperating contact element 9 and a break contact can be obtained by omitting the cooperating contact element 8.

The structure of the base member may likewise be seen in the perspective illustration of FIG. 4. The special characteristic at the base member is the asymmetrical design of the seating part 23 for the coil. This shaping creates a through-channel 24 at one side in the longitudinal direction in which the slide 7 can extend up to the recess 20. A shoe-like partition 25 is provided on the base member 1 for insulation between the coil 2, the core 3 and the yoke 4. After assembly of the functioning parts on the base member, a cap 26 is inverted thereover from above, the cap 26 additionally increasing the insulation between the magnetic circuit and the contact arrangement with a partition 27.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electromagnetic relay comprising:

a base member including a bottom surface forming a terminal side of the relay;

an electromagnetic system mounted on said base member including a coil, a core extending through said coil, and an armature pivotally mounted to extend adjacent one end of said coil and said core;

an actuation element coupled to said armature for transmitting armature movement; and a contact arrangement mounted to said base member spaced from the other end of said coil and core and including a movable contact coupled at an attack point to said actuation element and fixed contacts, each of said contacts comprising contact legs including contact locations and extending perpendicular to said bottom surface, the attack point of the coupling of said actuation element to said movable contact being offset laterally with respect to said contact location of said movable contact and in a common plane therewith perpendicular to said bottom surface of said base member so that they lie spaced apart in a perpendicular projection thereof onto said bottom surface.

2. The electromagnetic relay of claim 1, wherein:

said attack point is also offset in height from said contact location of said movable contact with respect to said bottom surface.

3. The electromagnetic relay of claim 1, wherein:

said coil is an elongate coil and comprises an axis lying parallel to said bottom surface;

said armature is arranged at said one end of said coil and core to extend approximately perpendicular to said bottom surface;

said actuation element comprises a rod-shaped slide extending in the direction of the coil axis outside of said coil; and said contact location of said movable contact is arranged at one side and said slide is arranged at the other side with reference to a plane extending through said coil axis and perpendicular relative to said bottom surface.

4. The relay of claim 3, and further comprising:

a yoke including a first leg extending along said coil on a side opposite said base member, said armature seated at the free end of said first leg; and wherein said slide is arranged between said coil and said base member.

5. The electromagnetic relay of claim 1, wherein:

said movable contact comprises a movable contact leg including an actuation tab which is obliquely offset relative to said contact location of said movable contact at a free end of said contact leg, said actuation tab including an aperture therethrough; and said actuation element comprises a projection extending through said aperture of said actuation tab.

6. The electromagnetic relay of claim 5, and further comprising:

a web of reduced cross section between said actuation tab and said contact location of said movable contact leg.

7. The electromagnetic relay of claim I, wherein:

said movable contact comprises a contact spring in the form of an inverted U which includes a fastening leg, a second leg carrying a contact piece at said contact location and said attack point; and a terminal element connected to said base member and secured to said fastening leg.

8. The electromagnetic relay of claim 7, wherein:

said contact arrangement comprises said terminal element anchored in said base member at one side of said base member;

at least one cooperating contact element anchored in said base member at an opposite side thereof; and said movable contact comprising two legs which are offset obliquely relative to one another to extend in parallel planes.

9. The electromagnetic relay of claim 8, wherein:

said terminal element comprises an adjustment web of reduced cross section.

* * * * *